US006742562B2

(12) United States Patent
Pitzen

(10) Patent No.: US 6,742,562 B2
(45) Date of Patent: Jun. 1, 2004

(54) MASKING TAPE APPLICATOR

(75) Inventor: James F. Pitzen, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/179,602

(22) Filed: Jun. 25, 2002

(65) Prior Publication Data

US 2003/0234083 A1 Dec. 25, 2003

(51) Int. Cl.[7] ..... B44C 7/04
(52) U.S. Cl. ..... 156/577; 156/579; 156/527
(58) Field of Search ..... 156/577, 579, 156/523, 527

(56) References Cited

U.S. PATENT DOCUMENTS

| | | | | | |
|---|---|---|---|---|---|
| 2,891,691 | A | * | 6/1959 | Burger | 156/577 |
| 2,953,274 | A | * | 9/1960 | Bertschinger | 156/577 |
| 3,156,603 | A | * | 11/1964 | Robinson | 156/577 |
| 3,740,297 | A | * | 6/1973 | Vidinsky | 156/523 |
| 5,269,871 | A | | 12/1993 | Longworth et al. | |
| 5,462,633 | A | * | 10/1995 | Manusch et al. | 156/577 |
| 6,302,177 | B1 | * | 10/2001 | Gruber | 156/527 |

* cited by examiner

*Primary Examiner*—Richard Crispino
*Assistant Examiner*—Michelle Acevedo Lazor
(74) *Attorney, Agent, or Firm*—William L. Huebsch

(57) ABSTRACT

A device for applying tape from a roll of tape (e.g., masking tape) along a surface to be protected with an edge of the tape extending along a juncture between the surface to be protected and a surface to be treated disposed at about a right angle with respect to the surface to be protected. The device includes a two portion housing around and journaling the tape roll, each portion having a tape contacting part of its inner surface in a first plane, and having in a second plane a guide part of its outer surface adapted to be slid along the surface to be treated. The first and second planes on each of the housing portions can be at a small angle with respect to each other and intersect along an application side of the housing. A pressure application structure is mounted on the housing with an outer edge each end of the pressure application structure at the intersection of the first and second planes for a different adjacent one of the housing portions, and with the generally cylindrically arcuate peripheral surface of the pressure application structure disposed at an angle of no greater than 90 degrees with respect to the second plane and projecting from the housing at the intersections of the first and second planes. Tape from the roll extends around the periphery of the pressure application structure so that the dispenser can be manually positioned with either housing portion against the surface to be treated and moved to apply the tape.

19 Claims, 6 Drawing Sheets

MASKING TAPE APPLICATOR

FIELD OF THE INVENTION

The present invention relates to devices for applying tape from a roll of tape (e.g., masking tape) along a surface to be protected with an edge of the tape extending along a juncture between the surface to be protected and a surface to be treated (e.g., painted) that is disposed at about a right angle with respect to the surface to be protected.

BACKGROUND OF THE INVENTION

Many devices have been designed for use to apply tape from a roll of tape (e.g., masking tape) along a surface to be protected with an edge of the tape extending along a juncture between the surface to be protected (e.g., a door or window molding) and a surface to be treated (e.g., a wall to be painted) that is disposed at about a right angle with respect to the surface to be protected. U.S. Pat. Nos. 5,269,871 (Longworth et al.) and U.S. Pat. No. 6,302,177 (Gruber) provide illustrative examples. While such prior art devices can be useful for this purpose, all such known prior art devices either are too expensive for use by most homeowners and the like, do not apply the tape at the exact location or with the accuracy that is desired, and/or lack versatility in that the tape can not be applied while moving the device in either of two directions along the surface to be protected without repositioning the roll of tape in the device.

DISCLOSURE OF THE INVENTION

The present invention provides a device for applying tape from a roll of tape (e.g., masking tape) along a surface to be protected with an edge of the tape extending along a juncture between the surface to be protected and a surface to be treated that is disposed at about a right angle with respect to the surface to be protected. The device is sufficiently inexpensive that it can be used by most homeowners and the like, applies the tape at exact desired locations with great accuracy, and can provide versatility in that the tape can be applied while moving the device in either of two directions along the surface to be protected without repositioning the roll of tape in the device.

The device according to the present invention includes a housing around a roll of tape comprising a length of tape wound around a core. That housing can comprise two housing portions, each housing portion having a tape contact part of an inner surface for the housing portion in a first plane along which a side of the tape wound around the core is positioned, and having in a second plane a guide part of an outer surface for the housing portion, which guide part of the outer surface is adapted to be slid along the surface to be treated. The first and second planes on each of the housing portions can be at a small angle with respect to each other (i.e., in the range of about 1 to 4 degrees such as about 1.5 degrees) and disposed to intersect along an application side of the housing. The device can also include a pressure application structure having opposite end portions (e.g., each end portion can comprise a pressure roller), which pressure application structure has a peripheral surface that is generally cylindrically arcuate (e.g., generally cylindrical about an axis when pressure rollers are used), and has outer edges at the ends of its peripheral surface. The pressure application structure is mounted on the housing with the peripheral surfaces of the end portions of pressure application structure generally in alignment, with a part of the peripheral surface of each of the end portions at or closely adjacent to its outer edge at the intersection of the first and second planes for a different adjacent one of the portions of the housing, and with the arcuate peripheral surface of the end portion of the pressure application structure disposed at an angle of no greater than 90 degrees with respect to the adjacent second plane (i.e., disposed at an angle in the range of about 80 to 90 degrees such as 87.5 degrees with respect to that second plane) and projecting from the housing at the intersection of the first and second planes. Means are provided for attaching the portions of the housing together and for journaling the roll of tape between the portions of the housing with the tape contact part of the inner surface for each housing portion along a different one of side surfaces of the wound length of tape included in the roll of tape. Means are also provided for defining a path for the length of tape from the periphery of the roll of tape to the periphery of the pressure application structure with the edges of the tape at or adjacent the intersections of the first and second planes and with adhesive included in the tape on the side of a backing included in the tape opposite the pressure application structure so that the dispenser can be manually positioned with either portion of the housing against the surface to be treated and moved along the surfaces to be treated and protected to accurately apply and press the tape from the roll of tape on the surface to be protected with the peripheral surface of the pressure application structure and with one edge of the tape at a predetermined relationship with respect to the juncture between the surface to be protected and the surface to be treated.

Each end portion of the pressure application structure can have an end surface projecting in the range of about 0.005 to 0.02 inch or 0.01 to 0.05 centimeter beyond the intersection of the first and second planes. That end surface can move along a surface to be treated and provide a predetermined small spacing along the surface to be protected between the surface to be treated and the adjacent edge of the tape being applied to the surface to be protected. That space is useful to insure that the surface to be treated is fully treated (e.g., if the surface to be treated is a wall being painted, the thickness of the edge of the tape will not prevent the paint from extending along the wall to the intersection between the wall and the surface to be protected).

In a similar alternative embodiment of the device, the first and second planes on each of the housing portions can be parallel to each other and spaced closely from each other (e.g., spaced in the range of 0.01 to 0.02 inch or 0.025 to 0.05 centimeter), with the arcuate peripheral surface of the pressure application structure disposed at an angle of no greater than 90 degrees with respect to the first and second planes.

The device according to the present invention can be made so that it will dispense only a single roll of tape, after which the housing is disposed of. If the device is made to be disposable, the means for attaching the portions of the housing together can comprise projections along opposing surfaces of the housing portions that can be mechanically engaged or can be fused together (e.g., with sonic or solvent welding) while the projections deform to allow the housing portions of a device being assembled to be pressed together to positions determined by a thin shim (removed after assembly) between the roll of tape and the housing at which a desired spacing (e.g., 0.010 inch or 0.025 cm) is provided between the side surfaces of the roll of tape and the tape contact parts of the inner surfaces of the housing. Such adjustable assembly of the housing is necessary because of the wide variance in the widths of rolls of masking tape (i.e., rolls of masking tape can have a width tolerance of plus or minus 0.060 inch or 0.15 cm).

Alternatively, the device can be made so that the housing portions are separable by a user to afford removal of an empty core and/or insertion of a new roll of tape, in which case to accommodate the wide variance in the widths of rolls of masking tape, the means for attaching the portions of the housing together can comprise a plurality of releasably engageable fasteners between the housing portions that afford free relative movement of the portions of the housing between a maximum spacing between the parts of the inner surfaces for the housing portions provided by the fasteners at which the widest of rolls of tape in the tolerance range will be received in the device, and an application position with the parts of the inner surfaces for the housing portions in contact with the side surfaces of the roll of tape at which application position the housing portions will be positioned by the user as the user manipulates the device to apply the tape. Alternatively, such releasably engageable fasteners could comprise spaced fasteners (e.g., screws) between the housing portions, and resiliently flexible members (e.g., springs or rubber grommets around the screws) between the housing portions that bias the housing portions to the maximum spacing between the parts of the inner surfaces for the housing portions provided by the fasteners, which maximum spacing could be determined by a shim (removed after assembly) between the roll of tape and the housing.

DESCRIPTION OF DRAWING

The present invention will be further described with reference to the accompanying drawing wherein like reference numerals refer to like parts in the several views, and wherein.

DETAILED DESCRIPTION OF THE INVENTION

Figure 1:
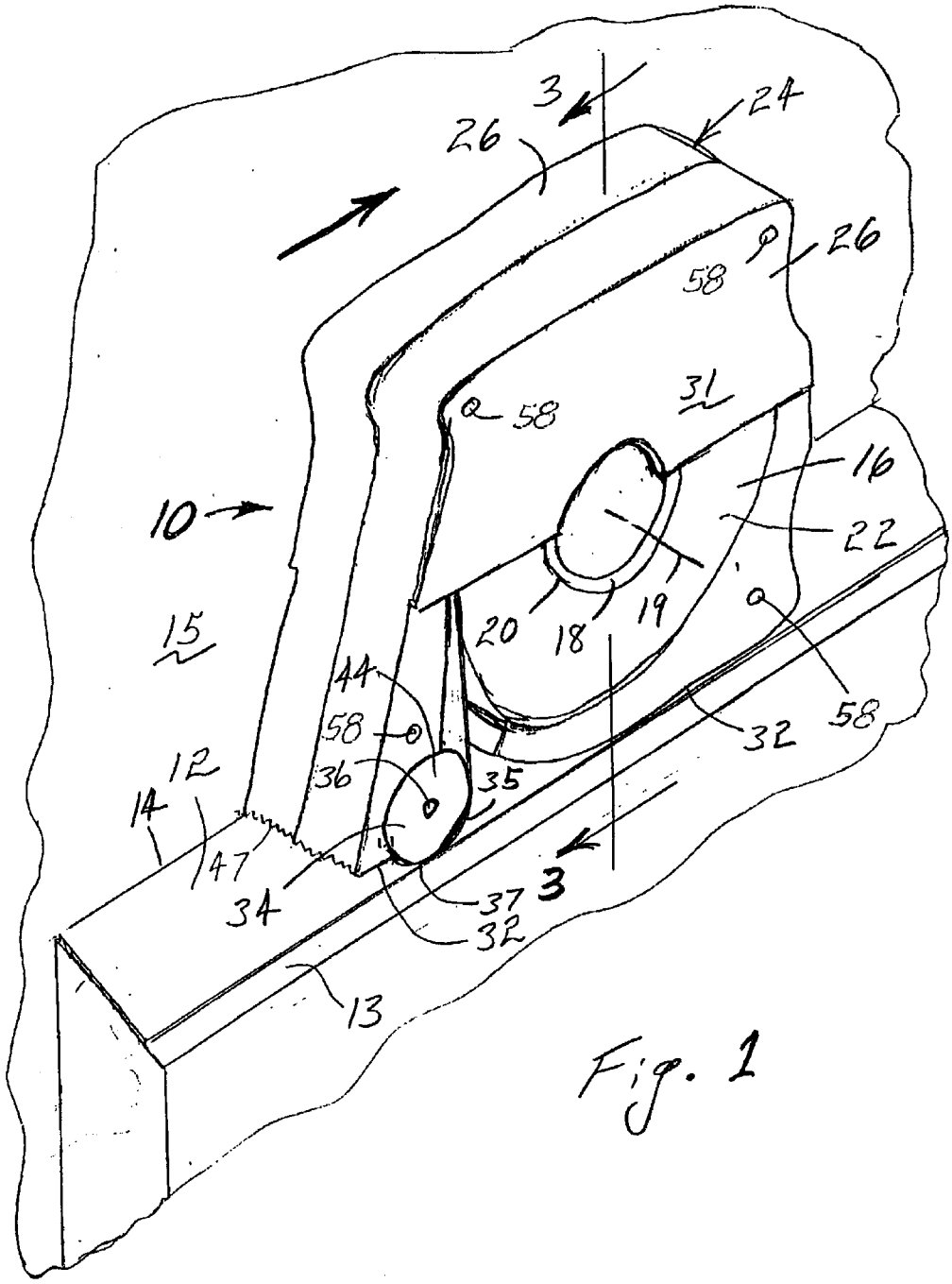
FIG. 1 is a perspective view of a first embodiment of a device according to the present invention being used to apply tape from a roll of tape along a surface to be protected with an edge of the tape extending along a juncture between the surface to be protected and a surface to be treated that is disposed at about a right angle with respect to the surface to be protected.

Referring now to FIGS. 1 through 4 of the drawing there is illustrated a first embodiment of a device 10 according to the present invention that can be manually used to apply a length of tape 12 along a surface 13 to be protected (e.g., the side surface 13 of a window or door molding) with an edge 14 of the tape 12 extending along a juncture between the surface 13 to be protected and a surface 15 to be treated (e.g., a wall 15 to be painted) disposed at about a right angle with respect to the surface 13 to be protected.

The device 10 includes a roll 16 of tape (e.g., masking tape of the type commercially available from 3M Company, St. Paul, Minn., that may nominally be ½, ¾, 1, or 2 inches or 1.3, 1.9, 2.5, or 5 centimeters wide) including a core 18 having an axis 19, a cylindrical periphery 20 around the axis 19, and including a length of the tape 12 (e.g., masking tape) that comprises a backing having opposite major surfaces extending between opposite elongate edges and a layer of pressure sensitive adhesive along one of the major surfaces. The length of tape 12 is wound around the periphery 20 of the core 18 with the edges of the wound tape 12 aligned to form generally planer side surfaces 22 for the roll 16 of tape. The device 10 also includes a housing 24 around the roll 16 of tape. The housing 24 comprises two allochiral housing portions 26 molded of a polymeric material (e.g., polystyrene, ABS, or polypropylene), each of which housing portions 26 has a tape contact part 28 of an inner surface for the housing portion 26 in a first plane 29, which tape contact part 28 is adapted to lay along one of the side surfaces 22 for the roll 16 of tape. Each housing portion 26 also has in a second plane 30 a guide part 31 of an outer surface for the housing portion 26 that is adapted to be slid along the surface 15 to be treated. The first and second planes 29 and 30 on each of the housing portions 26 are disposed at a small angle with respect to each other (i.e., at an angle in the range of about 1 to 4 degrees with respect to each other, and preferably at an angle of about 1.5 degrees with respect to each other) and are disposed to intersect along an application side 32 of the housing 24.

The device 10 also includes a pressure application structure having opposite end portions each comprising a pressure rollers 34. Each pressure roller 34 has a peripheral surface 35 that is generally cylindrically arcuate or cylindrical about an axis 36, and an outer edge 37 at one end of the peripheral surface 35. The pressure rollers 34 are mounted on the housing 24, each on a different one of the housing portion 26, for rotation about their axes 36, with the peripheral surfaces 35 of the pressure rollers 34 generally in alignment. Each of the pressure rollers 34 is mounted on the housing 24 with a part of the outer edge 37 of the pressure roller 34 at or closely adjacent (e.g., within 0.02 inch or 0.05 centimeter from) the intersection of the adjacent first and second planes 29 and 30 for a different one of the housing portions 26 (i.e., the intersection of the first and second planes 29 and 30 on the housing portion 26 on which the roller 34 is mounted), and with the generally cylindrical peripheral surface 35 of the pressure roller 34 disposed at an angle of no greater than 90 degrees with respect to the second plane 30 and projecting from the housing 24 at the intersection of the first and second planes 29 and 30. The pressure application structure also includes fixed parts of the housing portions 26 between the pressure rollers 34 that have generally cylindrically arcuate surfaces 39 generally aligned with the surface portions of the pressure rollers 34 that project from the housing 24 at any one time, which arcuate surfaces 39 provide pressure against, or at least support for, the portion of the tape being applied that extends between the pressure rollers 34.

One of several alternative means (four examples of which are described below) are provided for attaching the portions 26 of the housing 24 together. Also provided are means including two opposed semi-cylindrical projections 38 projecting toward each other from the housing portions 26 and having peripheral surfaces closely received along the inner surface of the core 18 for journaling the roll 16 of tape between the portions 26 of the housing 24 with the tape contact part 28 of the inner surface for each housing portion 26 along a different one of the side surfaces 22 of the roll 16 of tape. Also, means are provided for defining a path for the length of tape 12 from the periphery of the roll 16 of tape to the periphery of the pressure application structure with the edges of the tape at or closely adjacent the intersections of the first and second planes 29 and 30 and with the adhesive on the tape 12 on the side of the backing opposite the pressure application structure including its rollers 34 so that the dispenser 10 can be manually positioned with the guide part 31 of the outer surface of either portion 26 of the housing 24 against the surface 15 to be treated and moved along the surfaces 15 and 13 to be treated and protected to accurately apply and press the tape 12 from the roll 16 of tape on the surface 13 to be protected with the peripheral surfaces 35 of the pressure rollers 34 and with the edge 14 of the tape 12 at a predetermined relationship with respect to the juncture between the surface to be protected 13 and the surface 15 to be treated.

The generally cylindrical peripheral surface 35 of each pressure roller 34 should be disposed at an angle in the range of about 80 to 90 degrees (and preferably about 87.5 degrees) with respect to the second plane 30. This angle helps to insure that the peripheral surface 35 of the roller 35 applies firm pressure on the backing of tape being applied by the device 10 along the width of the roller 35 with a higher pressure being applied at and adjacent its outer edge 37.

Figure 2:
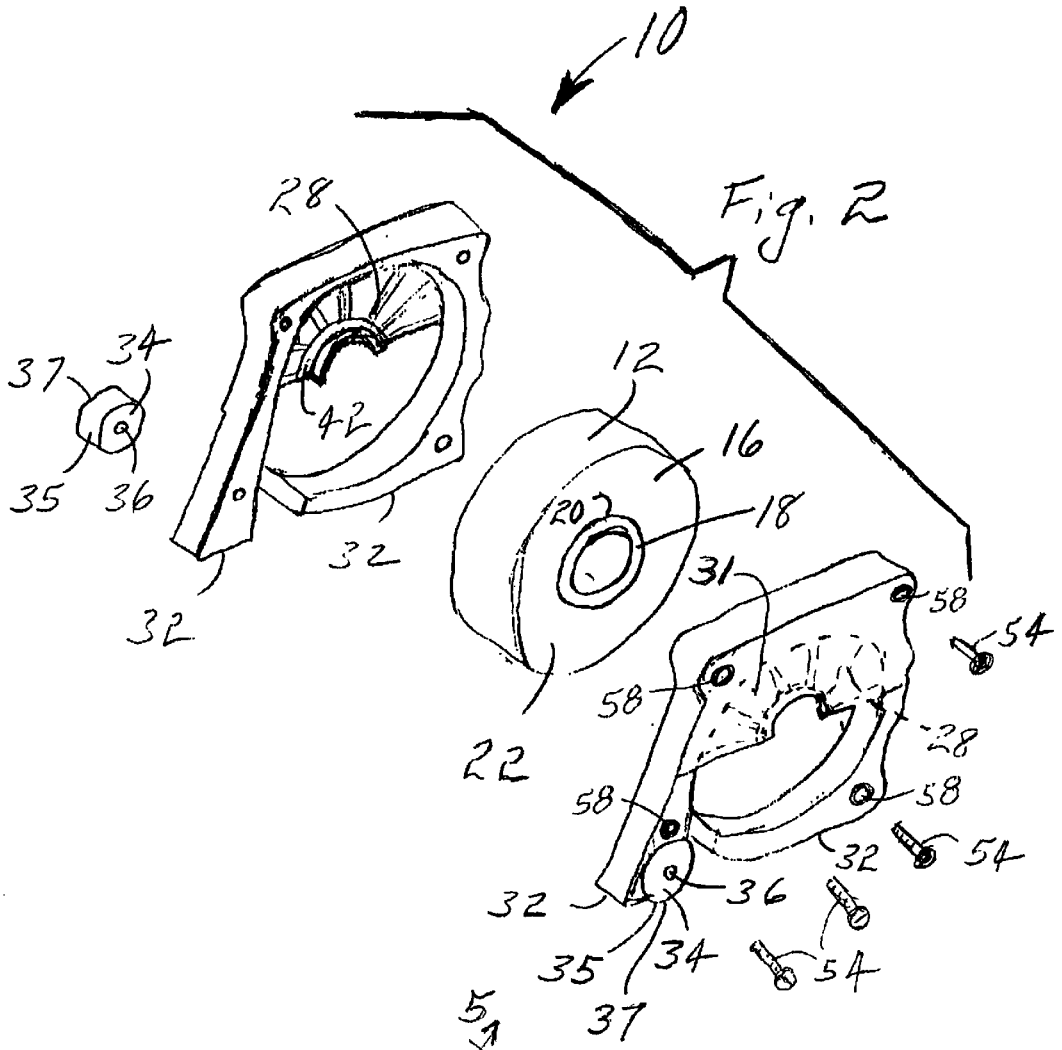
FIG. 2 is an exploded perspective view of the device of FIG. 1.

As is seen in FIG. 2, the tape contact part 28 of the inner surface for each housing portion 26 along a different one of the side surfaces 22 of the roll 16 of tape can be defined by ridges 40 extending radially from the axis 19 of the roll 16 of tape. Those ridges 40 restrict adhesion to the ridges 40 of adhesive that sometimes migrates to the side surfaces 22 of the roll 16 of tape.

Also, each housing portion 26 has adjacent the end of the core 18 a circular recess 42 from the tape contact part 28 of the inner surface along the side surface 22 of the roll 16 of tape to insure that those parts 28 of the inner surfaces for the housing portions 26 can contact the side surfaces 22 of the roll 16 of tape despite projections of the core 18 from the side surfaces 22 of the roll 16 of tape (i.e., cores typically project from the side surfaces of a roll of tape and can project as much as 0.050 inch or 0.13 cm from those side surfaces).

Each of the pressure rollers can, optionally, have an end surface 44 projecting in the range of about 0.010 to 0.020 inch beyond the second plane 30. This end surface 44 can contact the surface 15 to be treated as the guide part 31 of the outer surface of one of the housing portions 26 is slid along it, and can space the edge 14 of the tape 12 being applied to the surface 13 to be protected a short distance (about 0.010 to 0.020 inch) along that surface 13 to be protected from the surface 15 to be treated. This space insures that the surface 15 to be treated is fully treated (e.g., if the surface 15 to be treated is a wall being painted, the edge 14 of the tape 12 is spaced from the wall so that its thickness will not prevent the paint from extending along the wall to the intersection between the wall and the surface 13 to be protected).

The device 10 further includes means for providing a sharp tape cutting edge 47 on the housing 24 adjacent the pressure rollers 34 that is adapted for severing tape 12 applied to a surface to be protected from tape 12 in the device 10 by manual manipulation of the device 10. As illustrated, that edge 47 is provided by a row of teeth of a conventional type for severing masking tape molded into a narrow projecting edge portion of the housing 24 on the side of the pressure rollers 34 opposite the roll 16 of tape. Alternatively, that cutting edge 47 could be formed along the edge of a metal blade (not shown) attached to the housing 24, which metal blade could retain a sharp edge for a longer time than would the polymeric housing 24 as might be desirable if the dispenser 10 is made refillable (i.e., the housing portions 26 can be separated by a user of the device 10 to remove an empty core 18 and/or insert of a new roll 16 of tape and then again closed as described below).

Figure 4:
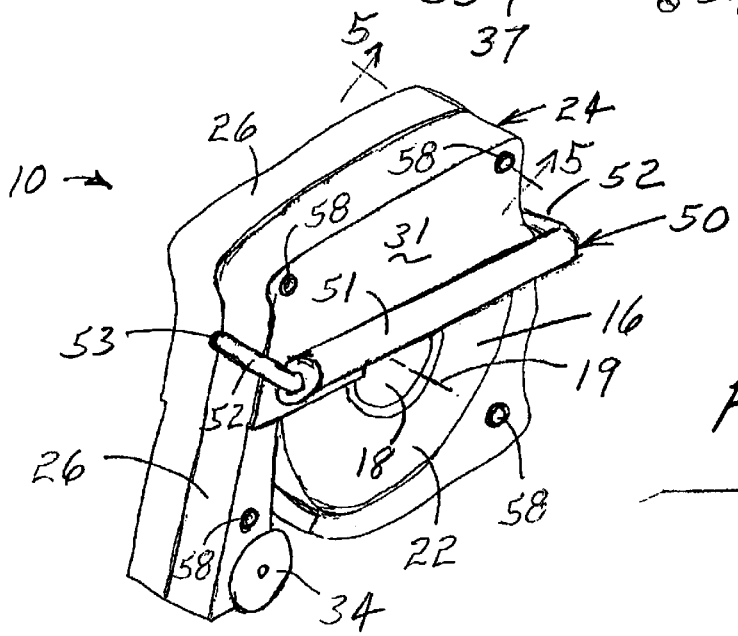
FIG. 4 is a perspective view of the device of FIG. 1 which has been modified by adding a handle.
Figure 3:
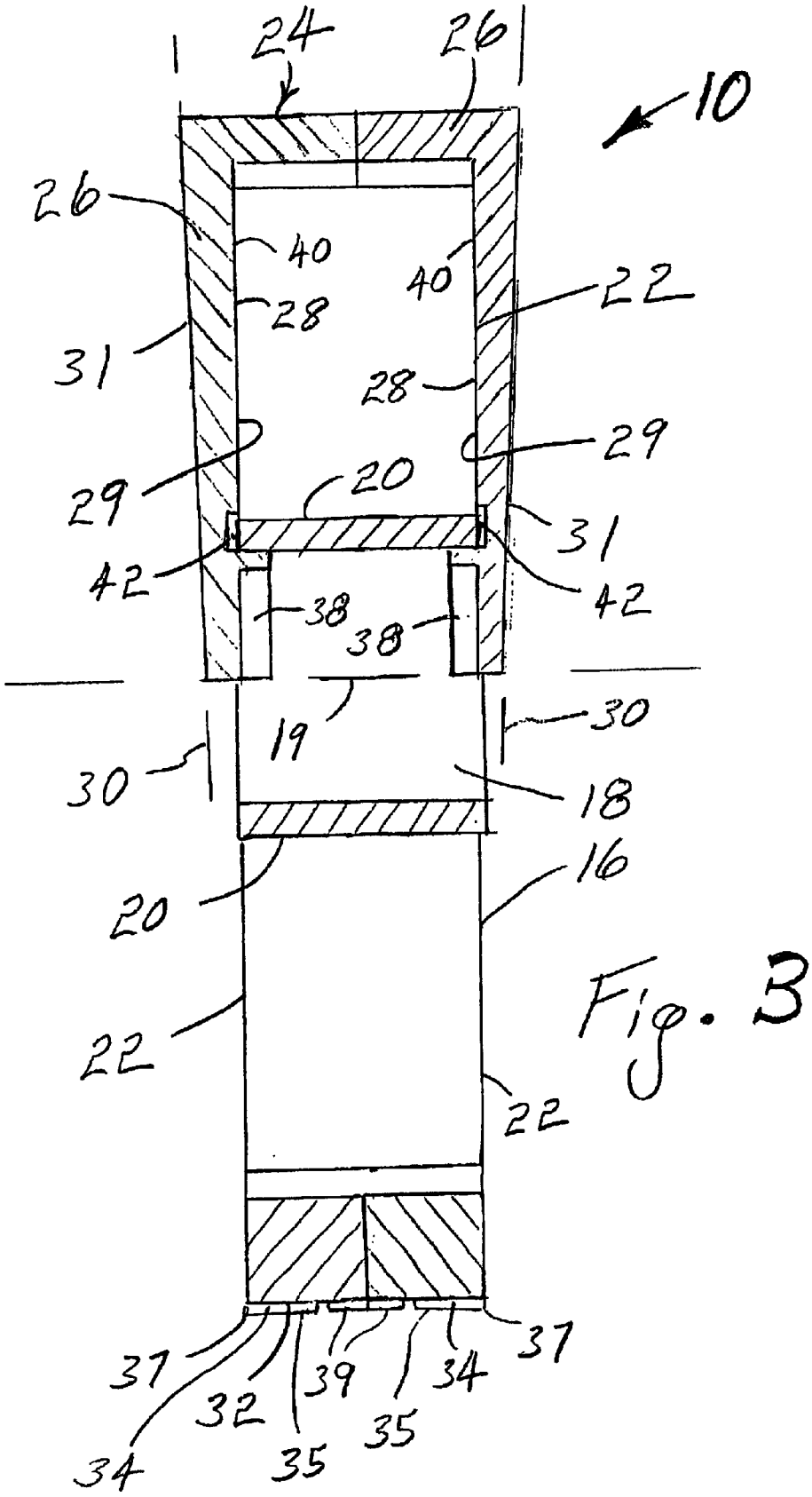
FIG. 3 is an enlarged sectional view of the device of FIG. 1 taken approximately along line 3—3 of FIG. 1.

Also, the device 10 can optionally, as is illustrated in FIG. 4, further include a handle 50 comprising an elongate central portion 51 adapted for manual engagement, and end portions 52 attached to opposite ends of the central portion 51 and projecting in the same direction generally normal to an elongate axis of the central portion 51, which end portions 52 have ends 53 opposite the central portion 51 pivotally attached to the housing 24 at the juncture of the housing portions 26. Such handle shape and attachment afford movement of the handle 50 between positions along the outer surfaces of either of the housing portions 26. The handle 50 can thus be moved to a position at which it can be manually engaged to move the device 10 in a desired direction along a surface 13 to be protected.

The means for attaching the portions 26 of the housing 24 together must provide a close tolerance between the tape contact parts 28 of the inner surfaces of the housing portions 26 and the side surfaces of the roll 16 of tape when tape is being applied by the device 10 to insure accurate positioning of the tape, while accommodating the wide variance in thickness of different rolls 16 of tape of the same nominal width (i.e., the manufacturing tolerance for the thickness of a roll 12 of masking tape is 0.06 inch or 0.15 cm above or below its nominal width).

Figure 5:
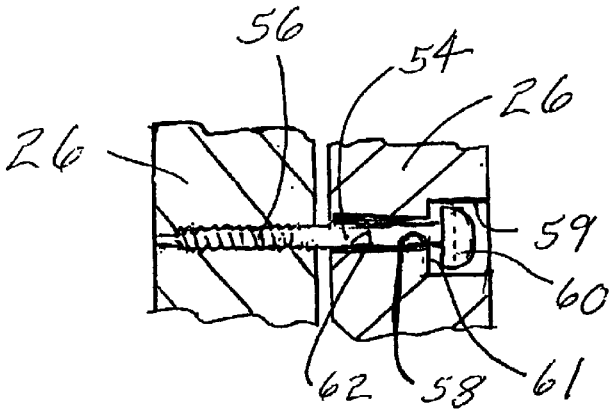
FIG. 5 is an enlarged sectional view of the device of FIG. 1 taken approximately along line 5—5 of FIG. 4 which illustrates a first one of alternative means for attaching together portions of a housing for that device.

The means for attaching the portions 26 of the housing 24 together (See FIG. 5) can include means affording relative movement of the housing portions 26 between a dispense position with the tape contact parts 28 of the inner surfaces of the housing portions 26 in contact with the side surfaces of the roll 16 of tape and a spaced position with at least one of the tape contact parts 28 spaced from the adjacent side surface of the roll 16 of tape by a fixed distance, which means affords separation of the housing portions 26 by a user of the device 10 to remove an empty core 18 and/or insertion of a new roll 16 of tape. Such means for attaching the portions 26 of the housing 24 together can comprise a plurality of (e.g., four) spaced releasably engageable fasteners or screws 54 between the housing portions 26, one of which is illustrated in FIG. 5. An end part of a threaded portion 56 of each screw 54 is in frictional threaded engagement with one portion 26 of the housing 24. The other portion 26 of the housing 24 has a through passageway 58 that is stepped to provide an outer portion 59 of the passageway in which a head 60 of the screw 54 is freely received, a shoulder 61 against which the head 60 of the screw 56 can bear, and an inner portion 62 in which the threaded portion 56 of the screw 54 is freely longitudinally moveable. Thus, the screws 54 afford free relative movement of the portions 26 of the housing 24 between the application position defined by contact of the tape contact parts 28 of the inner surfaces of the housing portions 26 with the side surfaces 22 of the roll 16 of tape and the spaced position that is determined by engagement of the heads 60 of the screws 54 against the shoulders 61, and which can be set to provide spacing from the widest of rolls 16 of tape in the width tolerance range for such rolls of tape (e.g., 0.01 inch or 0.025 cm wider than the width of the roll 16 of tape). The housing portions 26 will be moved to that application position as a user manipulates the device 10 to apply the tape because of pressure applied on an outer housing portion 26 by the user to slide the guide part 31 of the outer surface of the other housing portion 26 along a surface to be treated.

Figure 6:
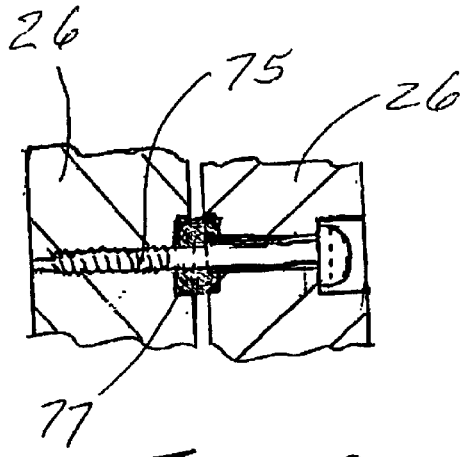
FIG. 6 is a sectional view similar to that of FIG. 5 which illustrates a second one of alternative means for attaching together portions of the housing for the device of FIG. 1.

Alternatively, the means for attaching the portions 26 of the housing 24 together (see FIG. 6) can include means fixing the relative positions of the housing portions 26 to provide a predetermined spacing between the side surfaces of the roll 16 of tape and the tape contact parts 28 of the inner surfaces of the housing for any specific width of the roll 16 of tape in the housing 24, which means affords separation of the housing portions 26 by a user of the device 10 to remove an empty core 18 and/or insertion of a new roll 16 of tape. An example of such means, illustrated in FIG. 6, comprises spaced fasteners or screws 75 between the housing portions 26, and resiliently flexible members (e.g., springs or, as illustrated, rubber grommets 77 around the screws 75) between the housing portions 26 that bias the housing portions 26 to the predetermined spacing that is set by the positions of the screws 75. That predetermined spacing (e.g., 0.01 inch or 0.025 cm) can be set by tightening the screws 75 with a shim (not illustrated) having about the thickness of that predetermined spacing between one side surface of the roll 16 of tape and the tape contact part 28 of the inner surface of the adjacent portion 26 of the housing, after which the shim is removed.

Figure 7:
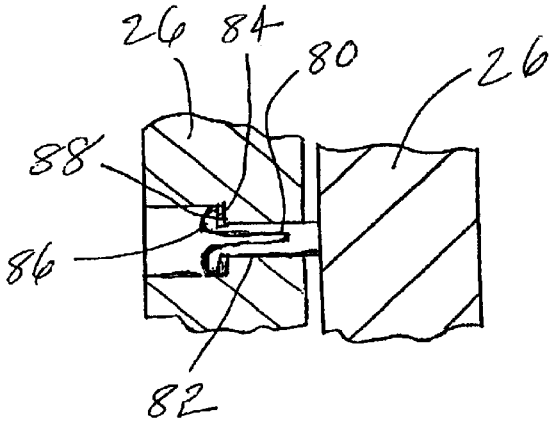
FIG. 7 is a sectional view similar to that of FIG. 5 which illustrates a third one of alternative means for attaching together portions of the housing for the device of FIG. 1.

As yet another alternative, the means for attaching the portions 26 of the housing 24 together (see FIG. 7) can include means affording relative movement of the housing portions 26 between the dispense position with the tape contact parts 28 of the inner surfaces of the housing portions 26 in contact with the side surfaces of the roll 16 of tape and the spaced position with at least one of the tape contact parts 28 spaced from the adjacent side surface of the roll 16 of tape by a fixed distance, which means do not afford easy separation of the housing portions 26 by a user of the device 10 so that the device 10 can be considered disposable. An example of such means for attaching the portions 26 of the housing 24 comprises a plurality of (e.g., four) spaced bifurcated hook-like members 80 integrally molded with and projecting from one of the housing portions 26, one of which is illustrated in FIG. 7. Most of the length of each of the hook-like members 80 is received in a passageway 82 through the other housing portion 26 with lips 84 on spaced heads 86 at the distal end of each of the hook like members 80 positioned in opposition to a shoulder 88 defined at a step in the diameter of the passageway 82 at the end of the passageway 82 opposite the other housing portion 24. The polymeric hook-like members 80 are sufficiently flexible to allow them to be pressed into the passageways 82 with their heads 86 closely adjacent each other until their heads 86 pass the shoulders 88 in the passageways 82 to thereby assembly the housing 24 around the roll 16 of tape, and the hook-like members 80 are then freely longitudinally moveable in the passageways 82 to afford free relative movement of the portions 26 of the housing 24 between the application position defined by contact of the tape contact parts 28 of the inner surfaces of the housing portions 26 with the side surfaces 22 of the roll 16 of tape, and the spaced position defined by engagement of the lips 84 on the heads 86 of the hook-like members 80 against the shoulders 88. That spaced position can be selected to provide spacing from the widest of rolls 16 of tape in the width tolerance range for such rolls 16 of tape (e.g., 0.01 inch or 0.025 cm wider than the maximum width for such a roll 16 of tape). The housing portions 26 will be moved to that application position as a user manipulates the device 10 to apply the tape because of pressure applied on an outer housing portion 26 by the user to slide the guide part 31 of the outer surface of the other housing portion 26 along a surface to be treated.

Figure 8:
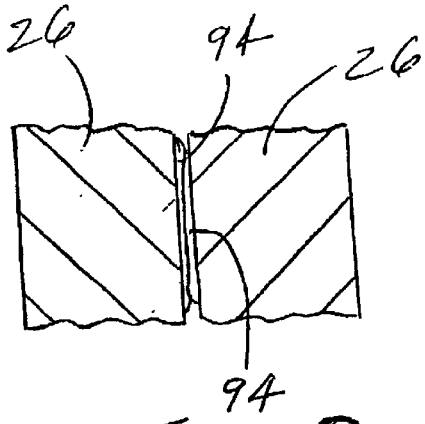
FIG. 8 is a sectional view similar to that of FIG. 5 which illustrates a forth one of alternative means for attaching together portions of the housing for the device of FIG. 1.

As yet another alternative, the means for attaching the portions 26 of the housing 24 together (see FIG. 8) can include means fixing the relative positions of the housing portions 26 to provide a predetermined spacing between the side surfaces of the roll 16 of tape and the tape contact parts 28 of the inner surfaces of the housing for any specific width of the roll 16 of tape in the housing 24, which means do not afford separation of the housing portions 26 by a user of the device 10 so that the device 10 is disposable. An example of such means, illustrated in FIG. 8, comprises projections 94 (e.g., ribs) along opposing surfaces of the housing portions 26 that can be fused together (e.g., with solvent or sonic welding) while the projections 94 deform to allow the housing portions 26 of the device 10 being assembled to be pressed together to a position determined by a shim (removed after assembly) between one side surface 22 of the roll 16 of tape and the tape contact part 28 of the inner surface of one portion 26 of the housing 24, at which position a desired predetermined spacing (e.g., 0.010 inch or 0.025 cm) is provided between the side surfaces 22 of the roll 16 of tape and the tape contact parts 28 of the inner surfaces of the housing 24.

Figure 9:
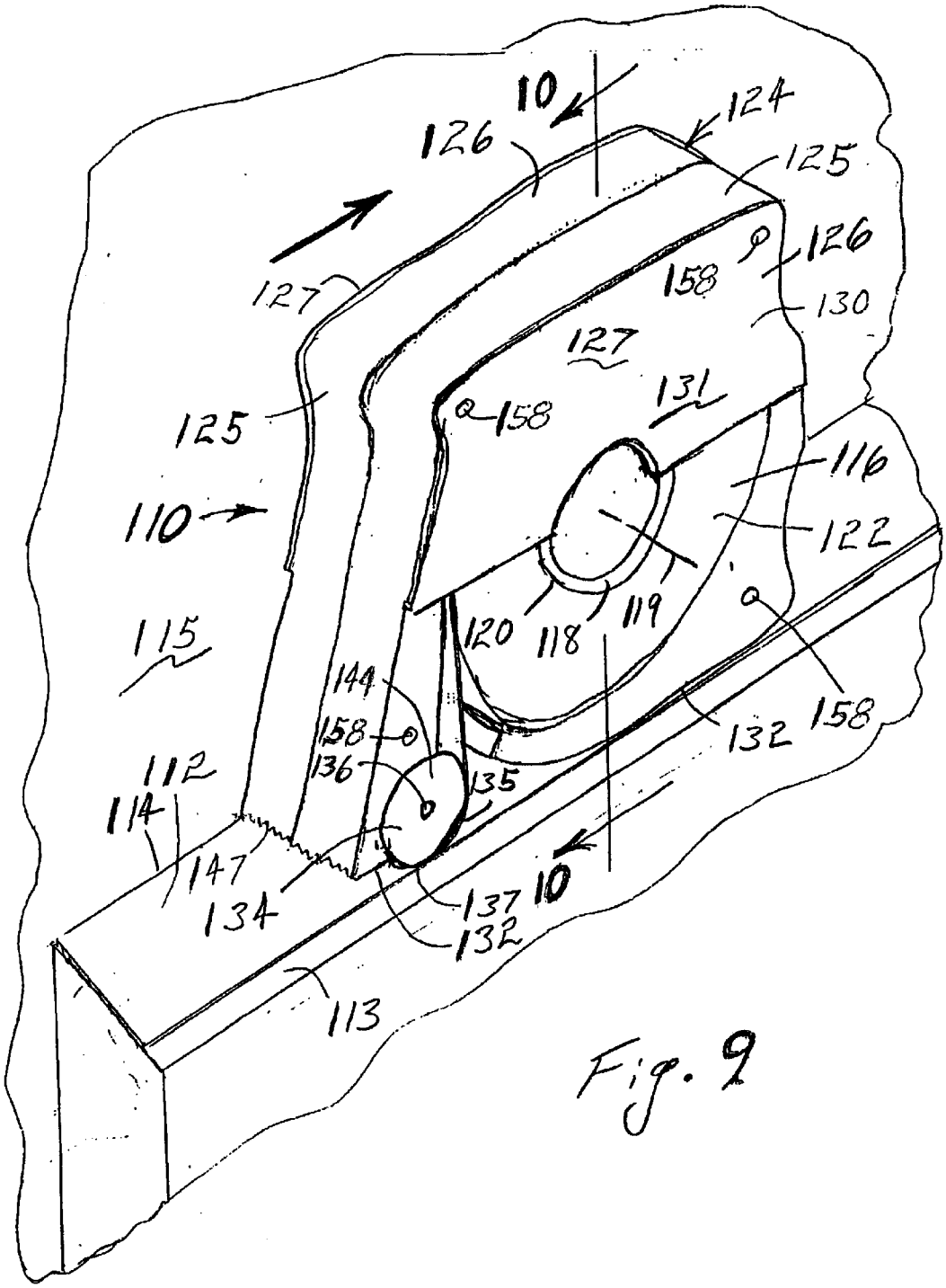
FIG. 9 is a perspective view of a second embodiment of a device according to the present invention that can be used to apply tape from a roll of tape along a surface to be protected with an edge of the tape extending along a juncture between the surface to be protected and a surface to be treated that is disposed at about a right angle with respect to the surface to be protected.
Figure 10:
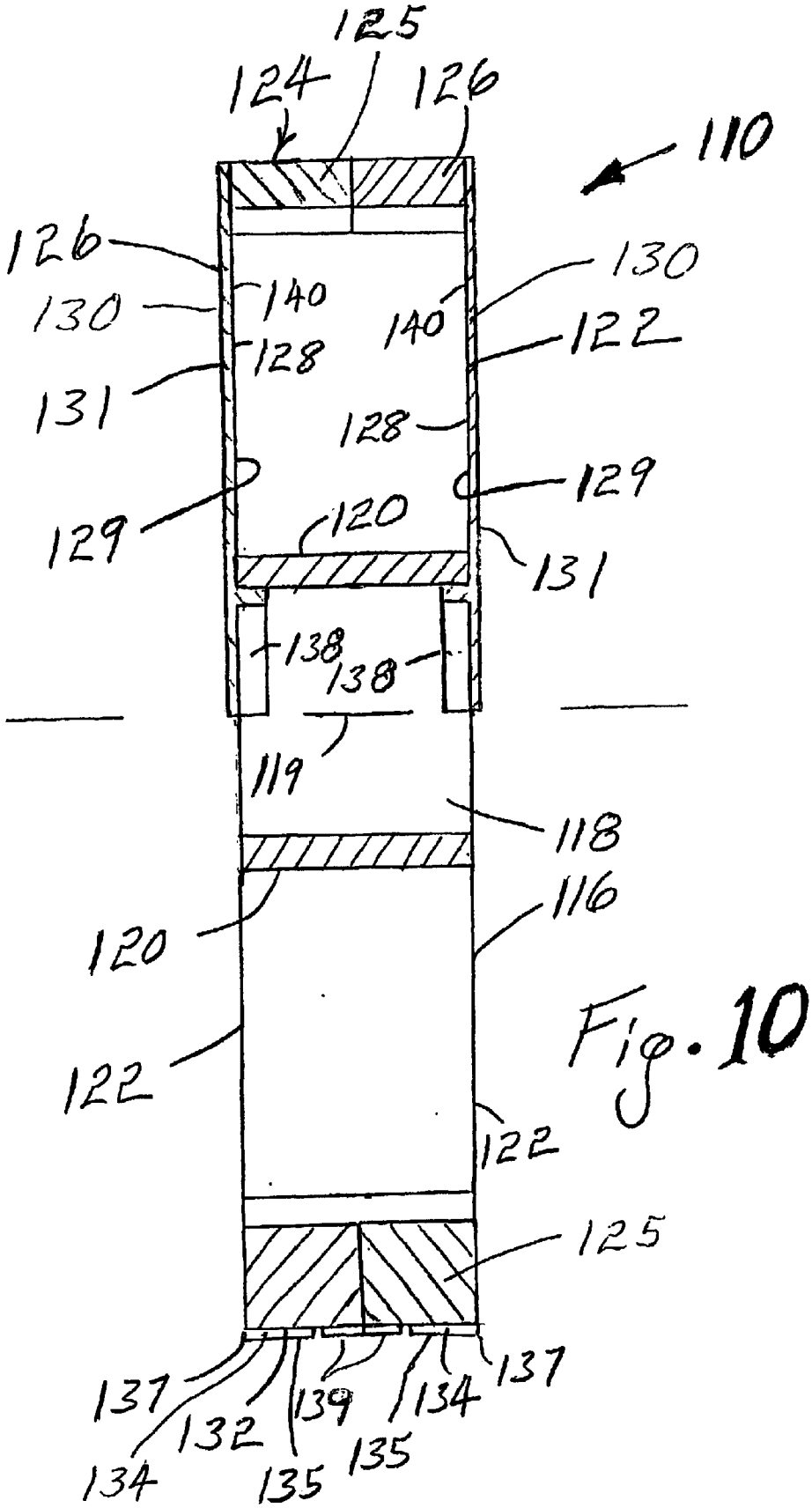
FIG. 10 is an enlarged sectional view of the device of FIG. 9 taken approximately along line 10—10 of FIG. 9.
Figure 1:
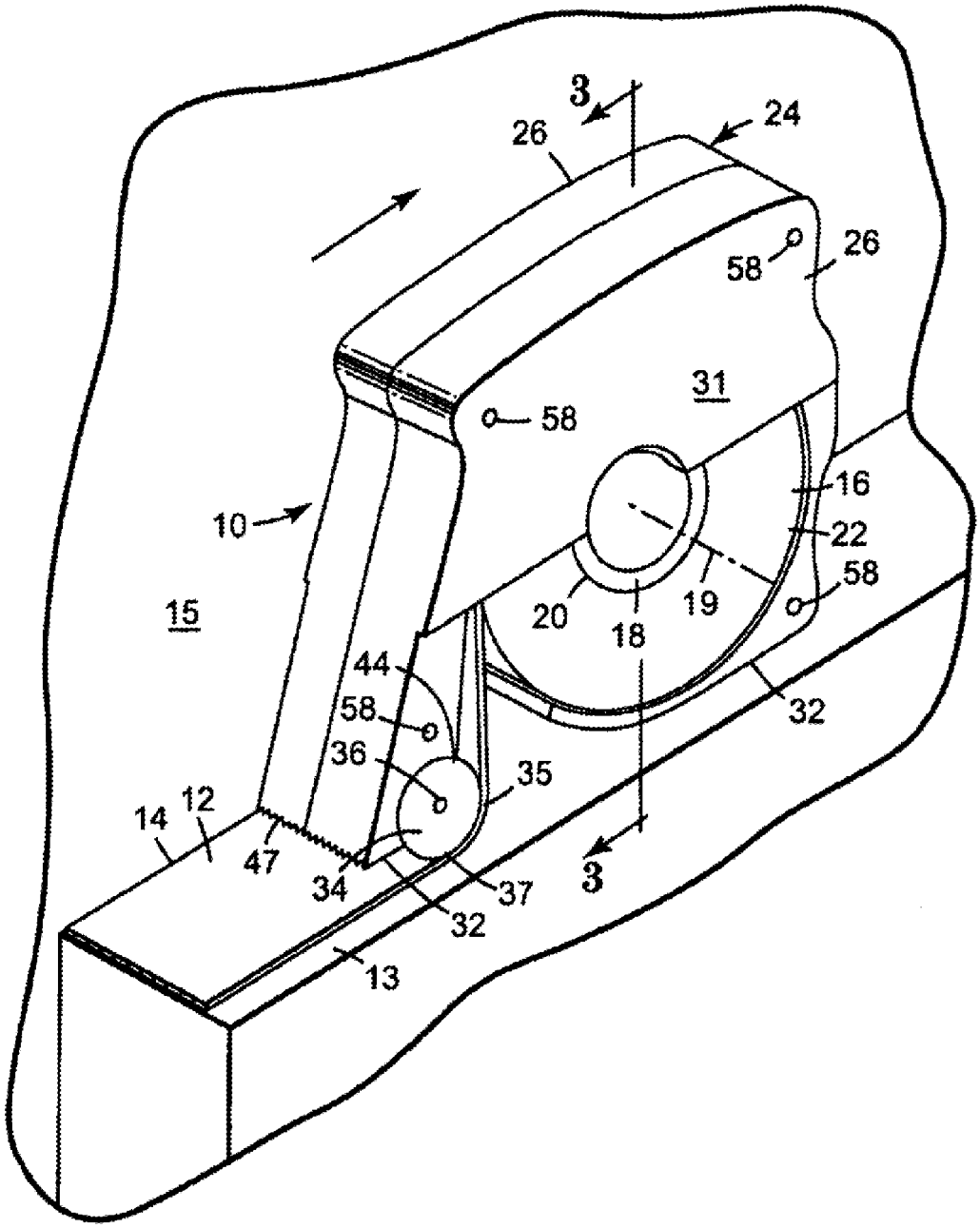
Figure 2:
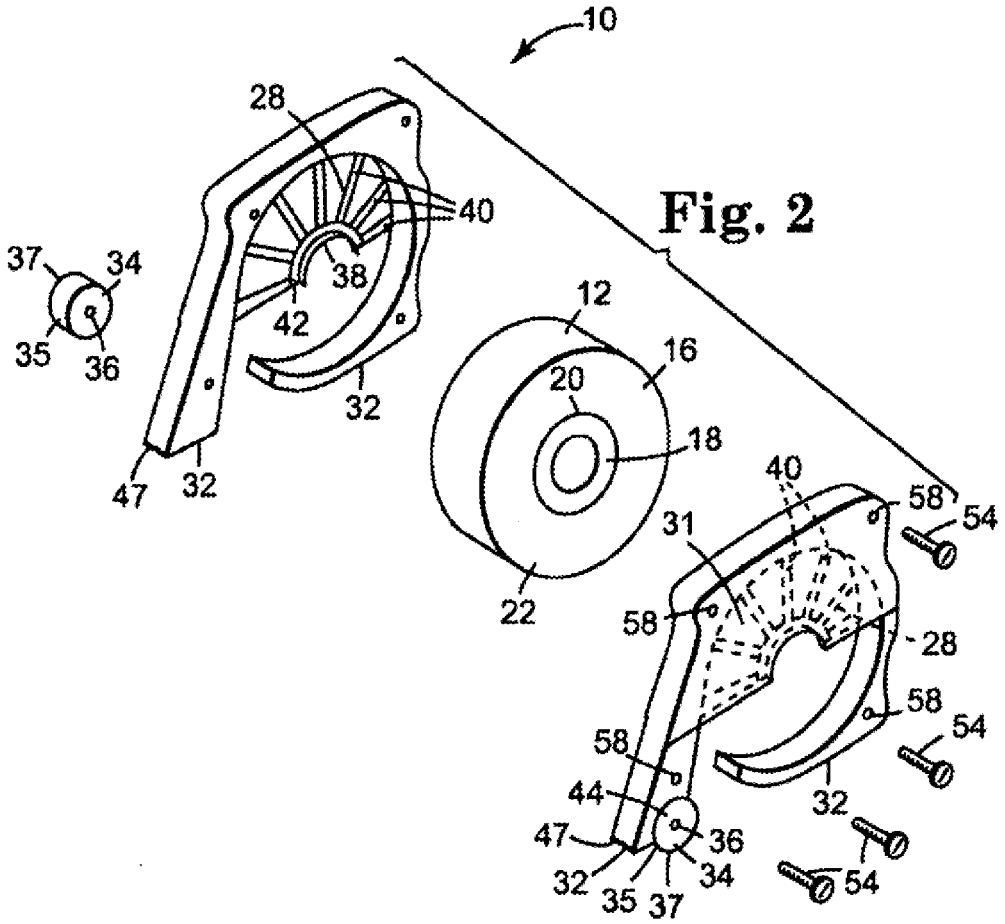
Figure 4:
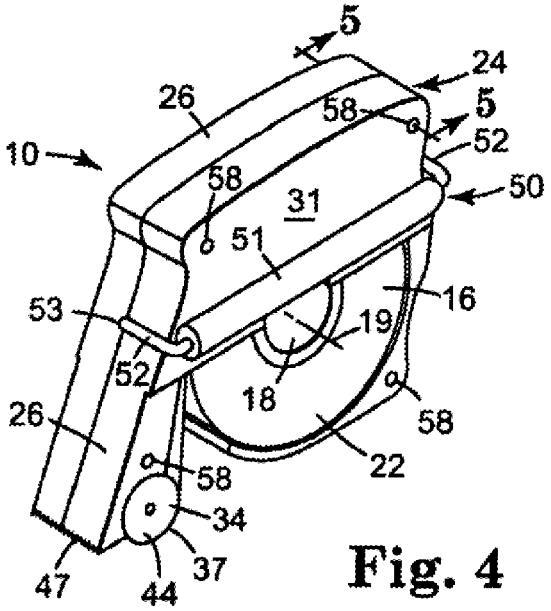
Figure 3:
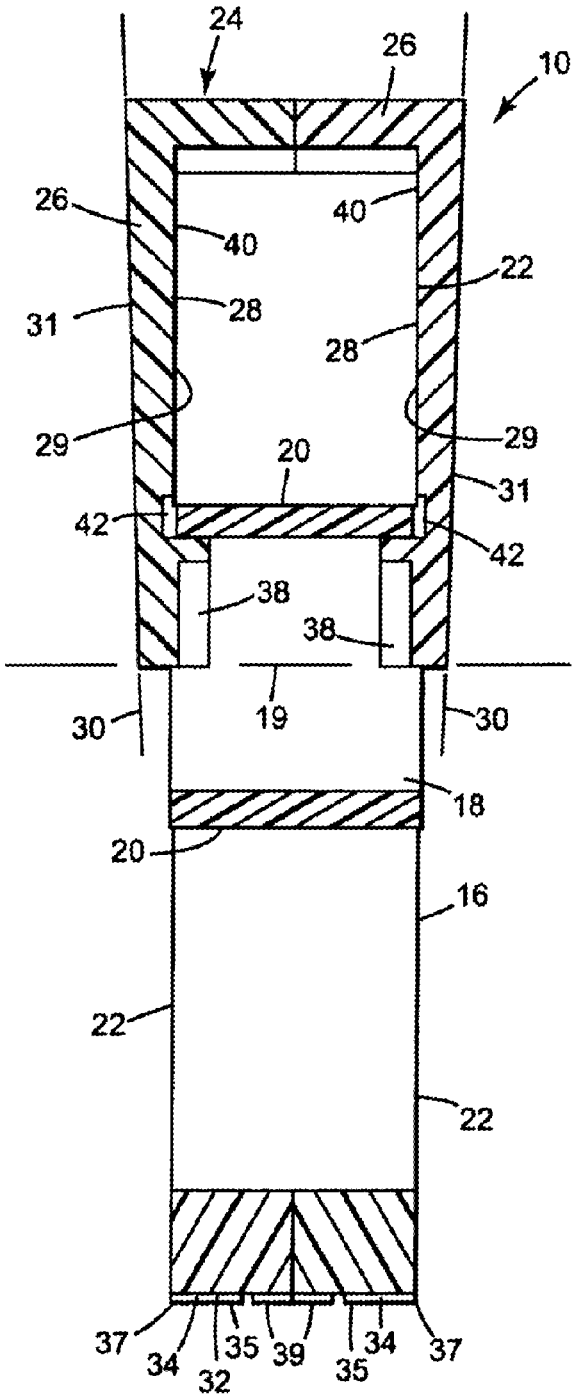
Figure 5:
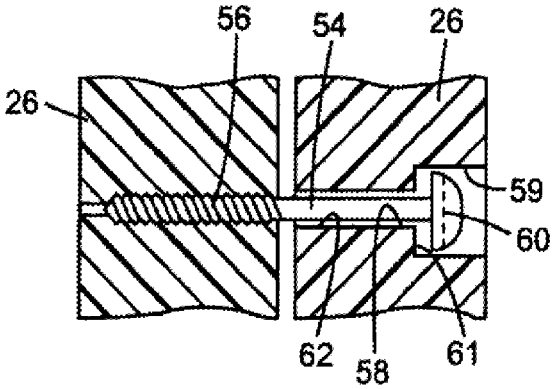
Figure 6:
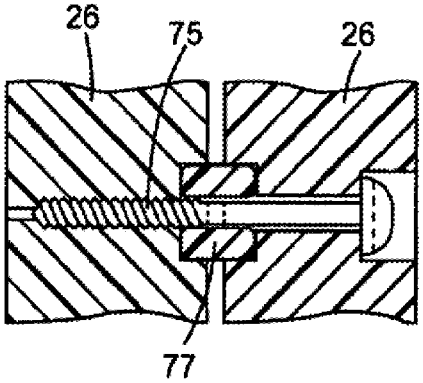
Figure 7:
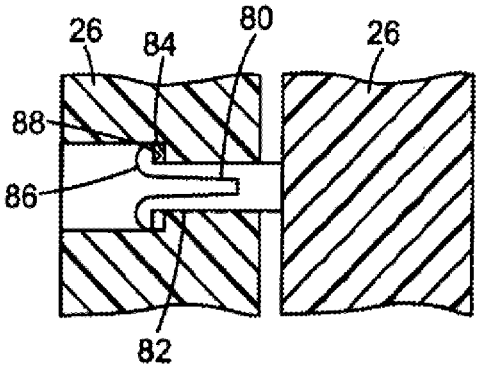
Figure 8:
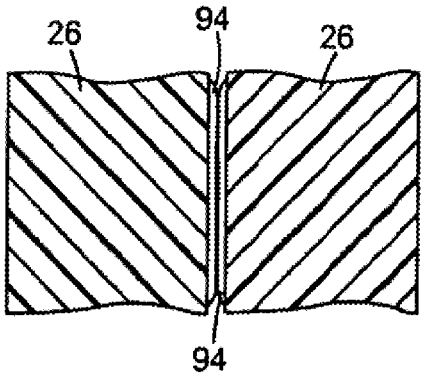
Figure 9:
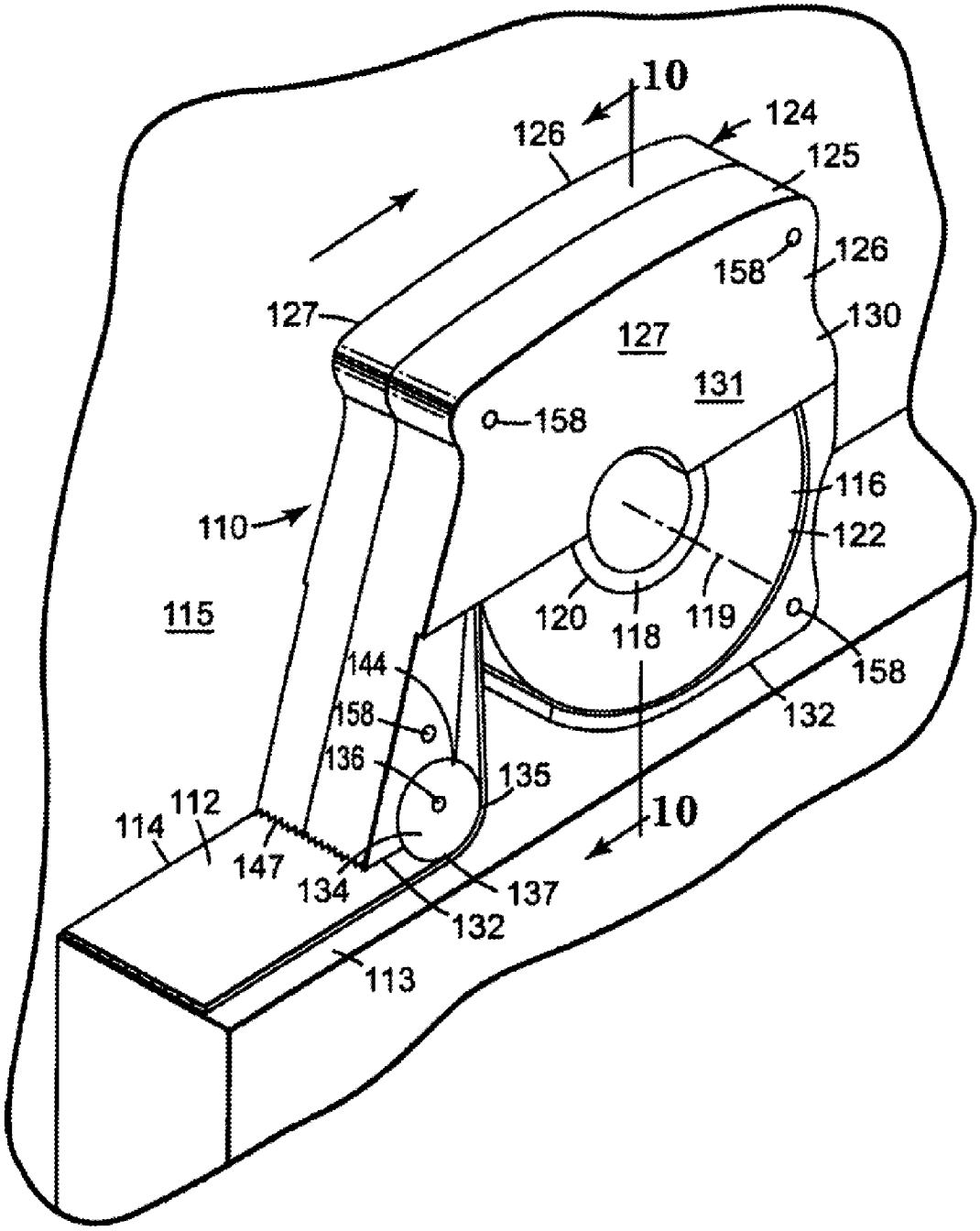
Figure 10:
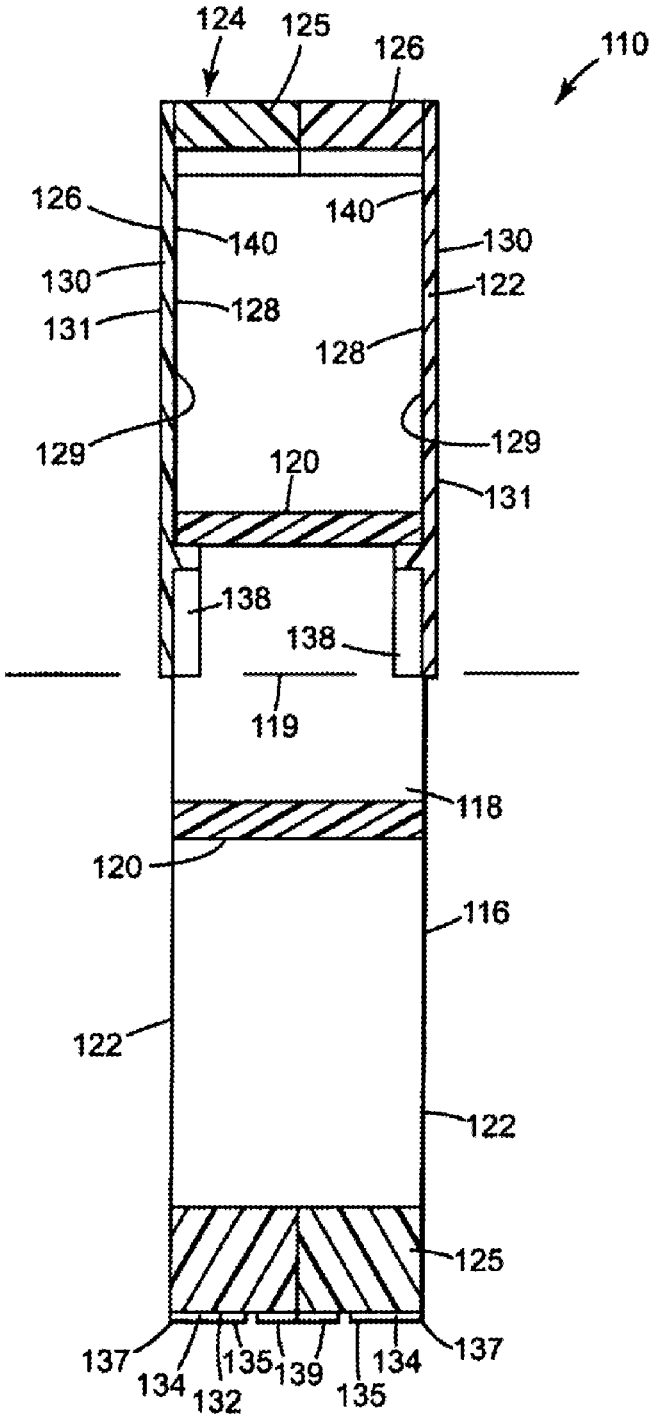
Figure 1:
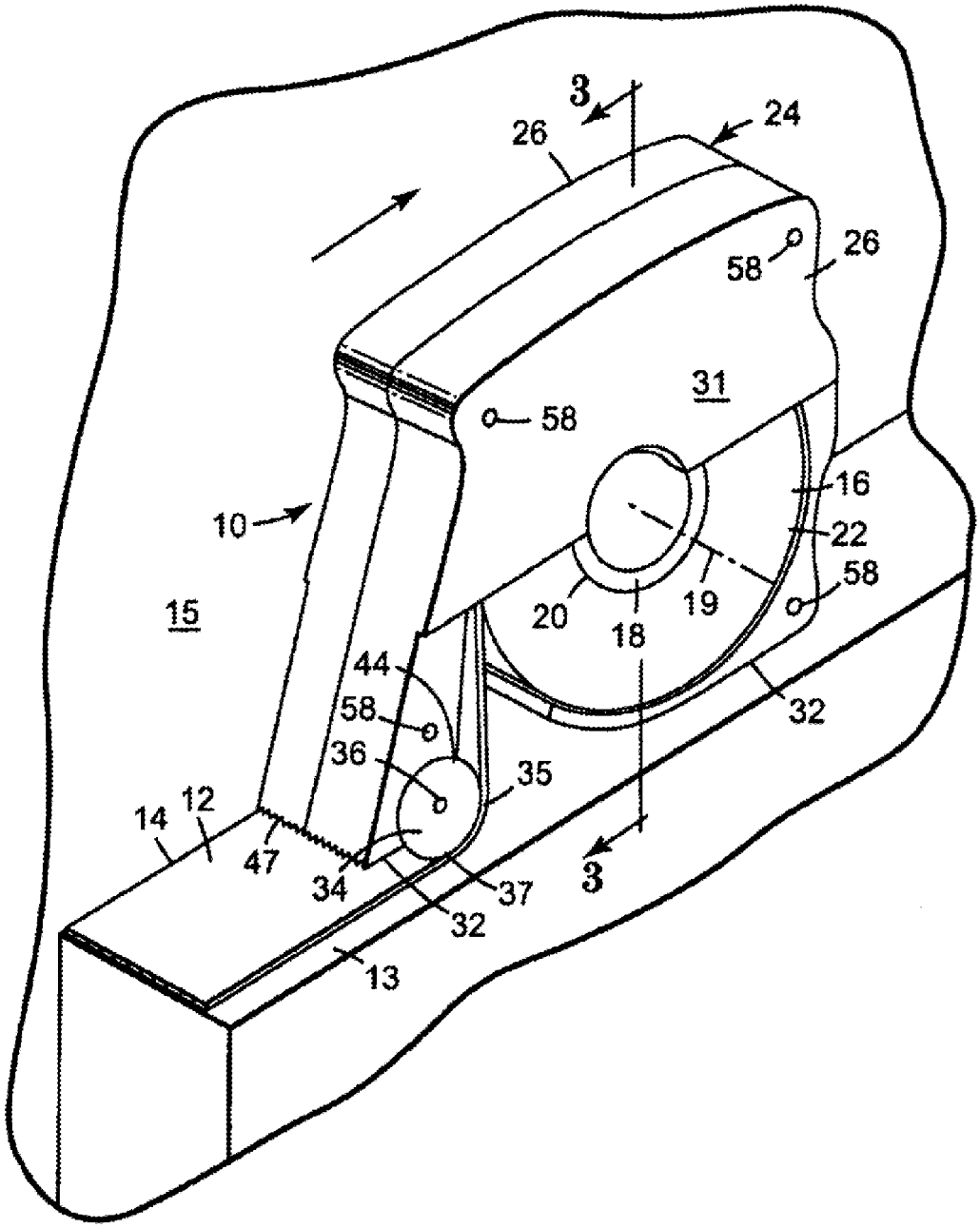
Figure 2:
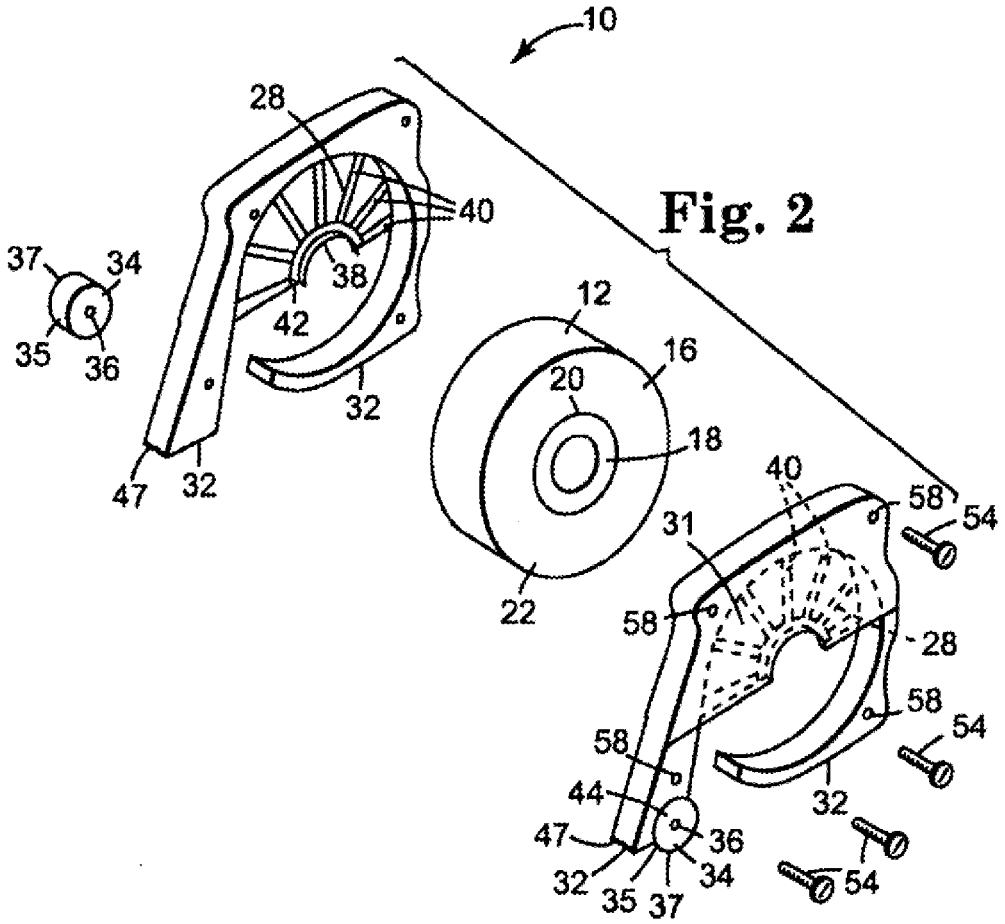
Figure 4:
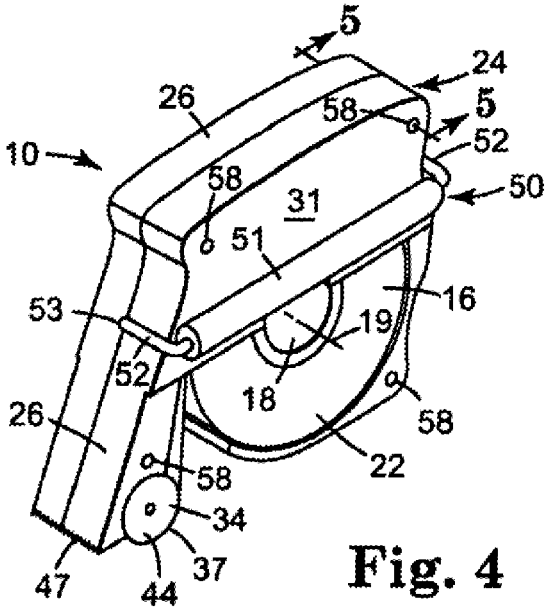
Figure 3:
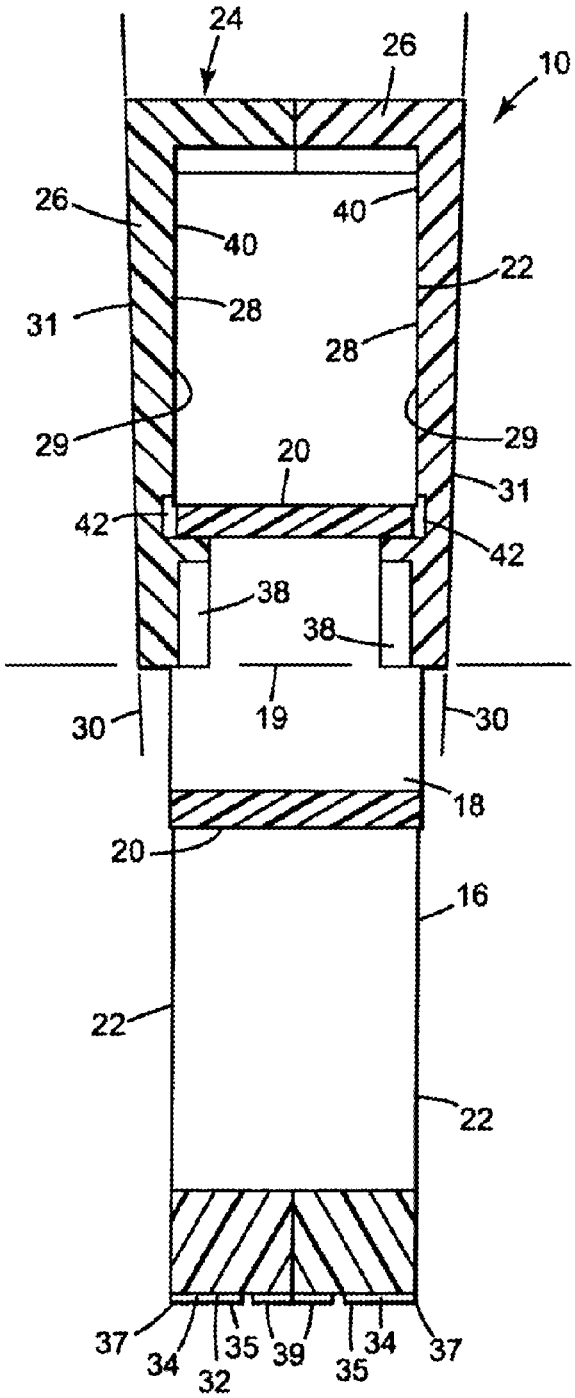
Figure 5:
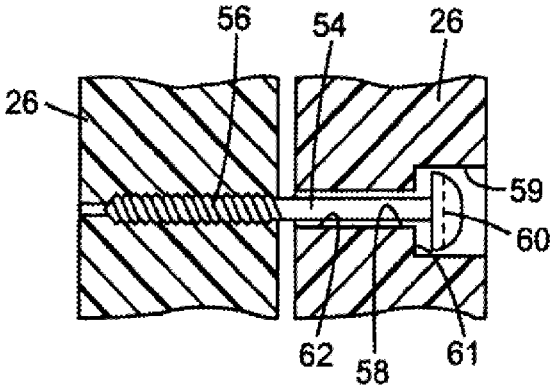
Figure 6:
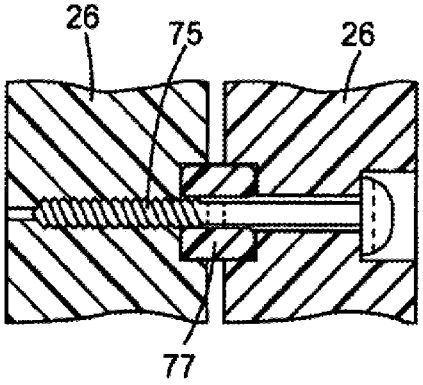
Figure 7:
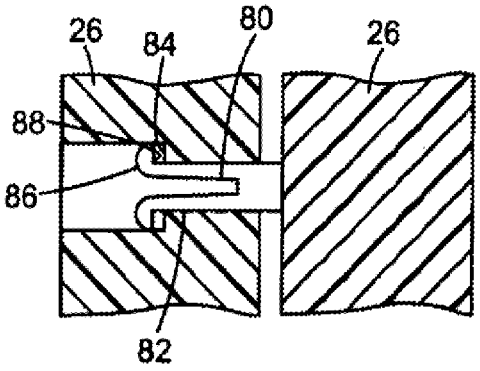
Figure 8:
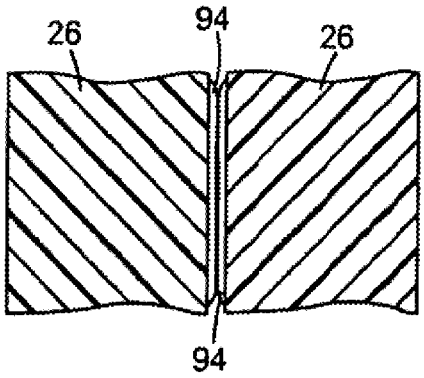
Figure 9:
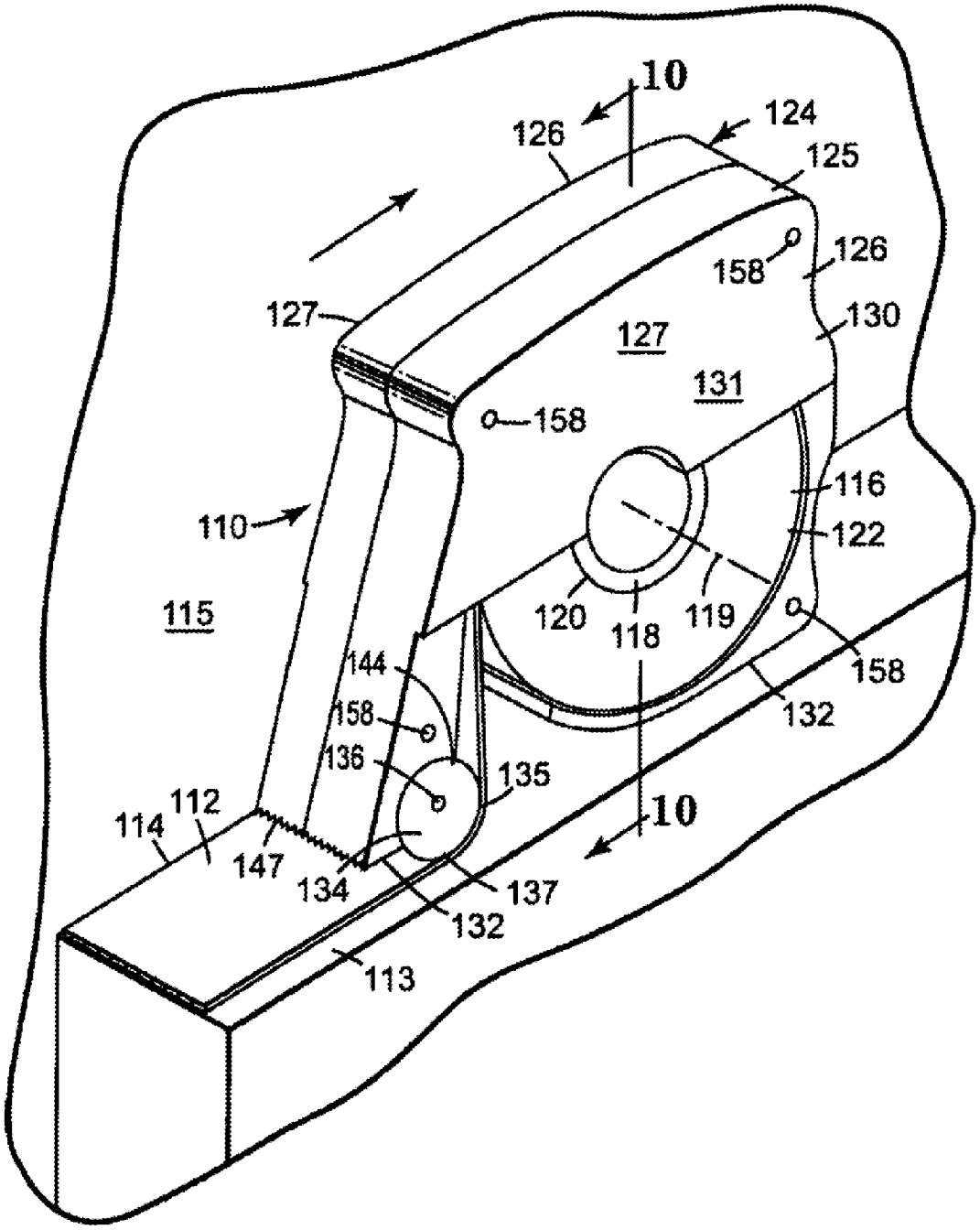
Figure 10:
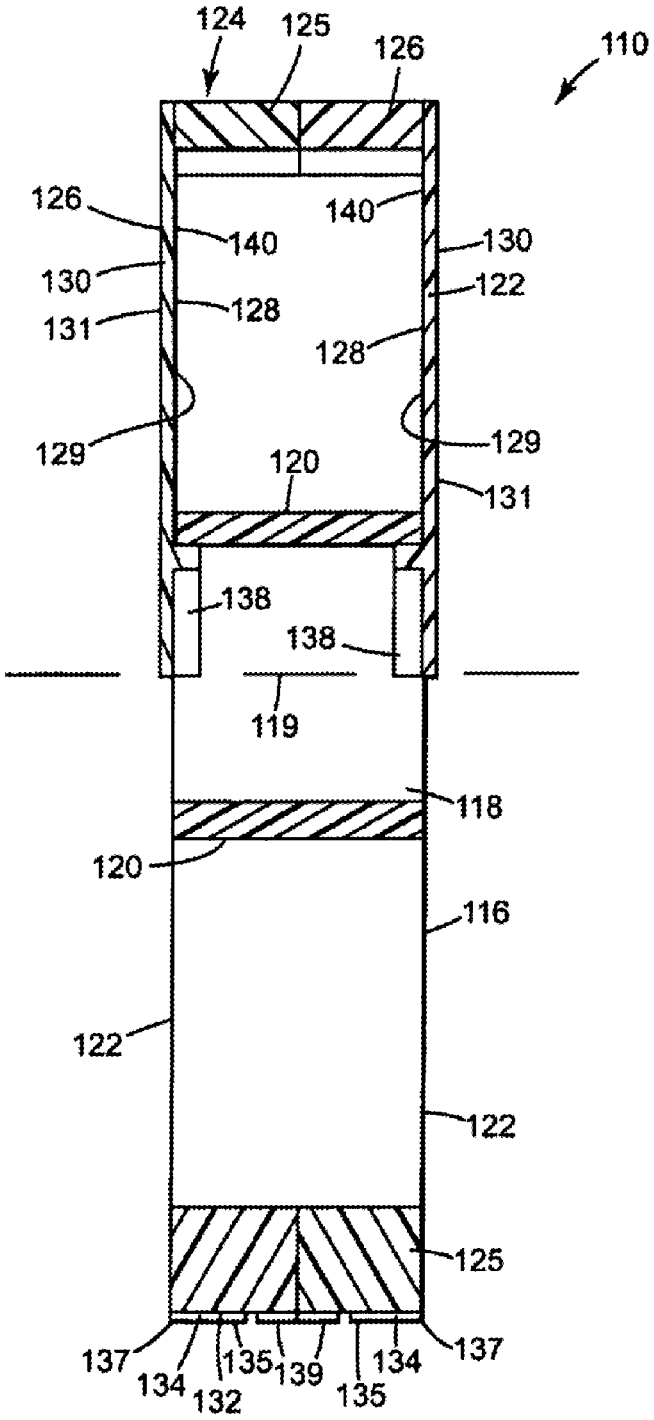

Referring now to FIGS. 9 and 10 of the drawing there is illustrated a second embodiment of a device 10 according to the present invention that can be manually used to apply a length of tape 112 along a surface 113 to be protected (e.g., the side surface 113 of a window or door molding) with an edge 114 of the tape 112 extending along a juncture between the surface 113 to be protected and a surface 114 to be treated (e.g., a wall to be painted) disposed at about a right angle with respect to the surface 113 to be protected.

The device 10 includes a roll 116 of tape (e.g., masking tape of the type commercially available from 3M Company, St. Paul, Minn., that may nominally be ½, ¾, 1, or 2 inches or 1.3, 1.9, 2.5, or 5 centimeters wide) including a core 118 having an axis 119, a cylindrical periphery 120 around the axis 119, and including a length of the tape 112 (e.g., masking tape) that comprises a backing having opposite major surfaces extending between opposite elongate edges and a layer of pressure sensitive adhesive along one of the major surfaces. The length of tape 112 is wound around the periphery 120 of the core 118 with the edges of the wound tape 112 aligned with each other and with the ends of the core 118 to form generally planer side surfaces 122 for the roll 116 of tape including its core 118 (i.e., as noted above, cores 118 often project from the side surfaces of the wound tape on a roll of tape so that aligning the edges of the wound tape with the ends of the core requires special winding of the tape on a core of the same width as the tape, or trimming away any projecting ends of the core after wining of the tape).

The device 110 also includes a housing 124 around the roll 116 of tape. The housing 124 comprises two allochiral housing portions 126, each of which housing portions 126 includes an inner part 125 molded of a polymeric material, and a side part 127 of a thin strong material (e.g., sheet metal) attached along one side of the inner part 125. Each of the housing portions 126 has a tape contact part 128 of an inner surface for the housing portion 126 in a first plane 129, which tape contact part 128 is adapted to lay along one of the side surfaces 122 for the roll 116 of tape. Each housing portion 126 also has in a second plane 130 a guide part 131 of an outer surface for the housing portion 126 that is adapted to be slid along the surface 115 to be treated. The first and second planes 129 and 130 on each of the housing portions 126 are along opposite surfaces of the side part 127 that are about parallel with each other, and are closely spaced from each other (e.g., less than about 0.02 inch or 0.05 centimeter or in the range of about 0.01 to 0.02 inch or 0.025 to 0.05 centimeter, such as about 0.015 inch or 0.037 centimeter from each other).

The device 110 also includes a pressure application structure having opposite end portions, each of which end portions comprises a pressure roller 134. Each pressure roller 134 has a peripheral surface 135 that is arcuate or generally cylindrical about an axis 136, and an outer edge 137 at one end of the peripheral surface 135. The pressure rollers 134 are mounted on the housing 124, each on a different one of the housing portions 126, for rotation about their axes 136, with the peripheral surfaces 135 of the pressure rollers 134 generally in alignment. Each of the pressure rollers 134 is mounted on the housing 124 with a part of the outer edge 137 of the pressure roller 134 aligned with or closely adjacent the first plane 129 for a different one of the housing portions 126 (i.e., the first planes 129 on the housing portion 126 on which the roller 134 is mounted), and with the generally cylindrical peripheral surface 135 of the pressure roller 134 disposed at an angle of no greater than 90 degrees with respect to the first and second planes 129 and 130 and from the housing. The pressure application structure also includes fixed parts of the housing portions 126 between the pressure rollers 134 that have generally cylindrically arcuate surfaces 139 generally aligned with the surface portions of the pressure rollers 134 that project from the housing 124, which arcuate surfaces 139 provide pressure against, or at least support for, the portion of the tape being applied that extends between the pressure rollers 134.

One of several alternative means (four examples of which are described above for the portions 26 of the housing 24) are provided for attaching the portions 126 of the housing 124 together in through passageways 158. Also provided are means including two opposed semi-cylindrical projections 138 projecting toward each other from the housing portions 126 and having peripheral surfaces closely received along the inner surface of the core 118 for journaling the roll 116 of tape between the portions 126 of the housing 124 with the tape contact part 128 of the inner surface for each housing portion 126 along a different one of the side surfaces 122 of the roll 116 of tape. Also, means are provided for defining a path for the length of tape 112 from the periphery of the roll 116 of tape to the periphery of the pressure application structure including its pressure rollers 134 with the adhesive on the tape 112 on the side of the backing opposite the pressure rollers 134 so that the dispenser 10 can be manually positioned with the guide part 131 of the outer surface of either portion 126 of the housing 124 against the surface to be treated and moved along the surfaces to be treated and protected to accurately apply and press the tape 112 from the roll 116 of tape on the surface to be protected with the pressure application structure and with the edge 114 of the tape 112 at a predetermined relationship with respect to the juncture between the surface to be protected and the surface to be treated.

The generally cylindrical peripheral surface 135 of each pressure roller 134 should be disposed at an angle in the range of about 80 to 90 degrees (and preferably about 87.5 degrees) with respect to the second plane 130. This angle helps to insure that the peripheral surface 135 of the roller 135 applies firm pressure on the backing of tape being applied by the device 110 along the width of the roller 135 with a higher pressure being applied at its outer edge 137.

Each of the pressure rollers can, optionally, have an end surface 44 projecting in the range of about 0.010 to 0.020 inch beyond the second plane 30. This end surface 44 can contact the surface 115 to be treated as the guide part 31 of the outer surface of one of the housing portions 26 is slid along it, and can space the edge 114 of the tape 112 being applied to the surface 113 to be protected a short distance (about 0.010 to 0.020 inch) along that surface 113 to be protected from the surface 115 to be treated. This space insures that the surface 115 to be treated is fully treated (e.g., if the surface 115 to be treated is a wall being painted, the edge 114 of the tape 112 is spaced from the wall so that its thickness will not prevent the paint from extending along the wall to the intersection between the wall and the surface 113 to be protected).

The device 110 further includes means for providing a sharp tape cutting edge 147 on the housing 124 adjacent the pressure rollers 134 that is adapted for severing tape 112 applied to a surface to be protected from tape 112 in the device 110 by manual manipulation of the device 110, which means can be one of those described above for the device 10.

Also, the device 10 can optionally further include a handle like the handle 50 described above for the device 10.

The present invention has now been described with reference to two embodiments and several modifications thereof. It will be apparent to those skilled in the art that many changes can be made in the embodiment described above without departing from the scope of the present invention. For example, a device for dispensing tape could be made having a housing comprising only one of the novel housing portions 26 or 126 described above. Also, the pressure application structures, instead of including the rollers 34 or 134 could be entirely provided by parts of the housing portions 26 or 126 that do not rotate, but are instead fixed relative to the housing portions 26 or 126, while still having generally cylindrically arcuate surfaces that are slid along the tape being applied to press that tape against the substrate to which it is being applied (e.g., extensions to the sides of the housing 24 or 124 of the parts of the housing portions 26 and 126 having the arcuate surfaces 39 or 139). Thus, the scope of the present invention should not be limited to the structures and methods described in this application, but only by the structures and method described by the language of the claims and the equivalents thereof.

What is claimed is:

1. A device manually used to apply tape along a surface to be protected with an edge of the tape extending along a juncture between the surface to be protected and a surface to be treated disposed at about a right angle with respect to the surface to be protected, said device including a roll of tape comprising a core having an axis, a cylindrical periphery around said axis, and a length of tape comprising a backing having opposite major surfaces extending between opposite elongate edges and a layer of pressure sensitive adhesive along one of said major surfaces, said length of tape being wound around said periphery with said edges aligned to form side surfaces for the roll of tape;

a housing receiving the roll of tape, said housing having an application side and comprising at least one housing portion, said housing portion having a tape contact part of an inner surface for the housing portion in a first plane, and having in a second plane a guide part of an outer surface for the housing portion adapted to be slid along the surface to be treated, said first and second planes on said housing portion being at an angle with respect to each other and disposed to intersect along the application side of said housing;

a pressure application structure, said pressure application structure having a generally cylindrically arcuate peripheral surface, and an outer edge at one end of said peripheral surface, said pressure application structure being mounted on said housing with a part of the outer edge of the pressure application structure at the intersection of said first and second planes and the generally cylindrically arcuate peripheral surface of the pressure application structure disposed at an angle of no greater than 90 degrees with respect to the second plane and projecting from the housing at the intersection of said first and second planes;

means for journaling the roll of tape on the housing with said tape contact part of the inner surface for the housing portion along one of the side surfaces of the roll of tape; and means for defining a path for the length of tape from the periphery of the roll of tape to the periphery of said pressure application structure at the intersection of said first and second planes with the adhesive on the tape on the side of the backing opposite the pressure application structure so that the dispenser can be manually positioned with the portion of the housing against the surface to be treated and moved along the surfaces to be treated and protected to accurately apply and press the tape from the roll of tape on the surface to be protected with the peripheral surface of the pressure application structure and with the edge of the tape at a predetermined relationship with respect to the juncture between the surface to be protected and the surface to be treated.

2. A device according to claim 1 wherein on said housing portion said first and second planes are at an angle in the range of about 1 to 6 degrees with respect to each other, and the generally cylindrically arcuate peripheral surface of the pressure application structure is disposed at an angle in the range of about 80 to 90 degrees with respect to the second plane.

3. A device according to claim 1 wherein on said housing portion said first and second planes are at an angle of about 1.5 degrees with respect to each other, and the generally cylindrically arcuate peripheral surface of the pressure application structure is disposed at an angle of about 87.5 degrees with respect to the second plane.

4. A device according to claim 1 wherein said tape contact part of the inner surface for said housing portion along the side surface of the roll of tape is defined by ridges extending radially from the axis of said roll of tape, and the housing portion has a recess from said tape contact part of the inner surface for the housing portion adjacent said core.

5. A device according to claim 1 wherein said pressure application structure has an end surface projecting in the range of about 0.005 to 0.020 inch or 0.01 to 0.05 centimeter beyond the intersection of said first and second planes.

6. A device according to claim 1 further including means for providing a sharp edge on said housing adjacent said pressure application structure adapted for severing tape applied to the surface to be protected from tape in said device by manual manipulation of the device.

7. A device according to claim 1 wherein said pressure application structure comprises a pressure roller having a peripheral surface that is generally cylindrical about an axis providing at least a portion of said cylindrically arcuate peripheral surface, said outer edge is at one end of said peripheral surface, and said pressure roller is mounted on the housing for rotation about said axes with a part of the outer edge of the pressure roller at the intersection of said first and second planes and the generally cylindrical peripheral surface of the pressure roller disposed at an angle of no greater than 90 degrees with respect to the second plane.

8. A device manually used to apply tape along a surface to be protected with an edge of the tape extending along a juncture between the surface to be protected and a surface to be treated disposed at about a right angle with respect to the surface to be protected, said device including a roll of tape comprising a core having an axis, a cylindrical periphery around said axis, and a length of tape comprising a backing having opposite major surfaces extending between opposite elongate edges and a layer of pressure sensitive adhesive along one of said major surfaces, said length of tape being wound around said periphery with said edges aligned to form side surfaces for the roll of tape;

a housing around the roll of tape, said housing having an application side and comprising two housing portions, each of said housing portions having a tape contact part of an inner surface for the housing portion in a first plane, and having in a second plane a guide part of an outer surface for the housing portion adapted to be slid along the surface to be treated, said first and second planes on each of said housing portions being at an angle with respect to each other and disposed to intersect along the application side of said housing;

a pressure application structure having opposite end portions, each end portion of said pressure application structure having a generally cylindrically arcuate peripheral surface, and an outer edge, said pressure application structure being mounted on the housing with the peripheral surfaces of said end portions generally in alignment each of said end portions being mounted on the housing with a part of the outer edge on the end portion at the intersection of said first and second planes for a different one of the portions of the housing, and the generally cylindrical arcuate peripheral surface of the end portion disposed at an angle of no greater than 90 degrees with respect to the adjacent second plane and projecting from the housing at the intersections of said first and second planes;

means for attaching said portions of the housing together and for journaling the roll of tape between the portions of the housing with said tape contact part of the inner surface for each housing portion along a different one of the side surfaces of the roll of tape; and means for defining a path for the length of tape from the periphery of the roll of tape to the periphery of said pressure application structure with the adhesive on the tape on the side of the backing opposite the pressure rollers so that the dispenser can be manually positioned with either portion of the housing against the surface to be treated and moved along the surfaces to be treated and protected to accurately apply and press the tape from the roll of tape on the surface to be protected with the peripheral surfaces of the pressure application structure and with the edge of the tape at a predetermined relationship with respect to the juncture between the surface to be protected and the surface to be treated.

9. A device according to claim 8 wherein on each of said housing portions said first and second planes are at an angle in the range of about 1 to 4 degrees with respect to each other, and the generally cylindrically arcuate peripheral surfaces of the end portions of the pressure application structure are disposed at an angle in the range of about 80 to 90 degrees with respect to the adjacent second plane.

10. A device according to claim 8 wherein on each of said housing portions said first and second planes are at an angle of about 1.5 degrees with respect to each other, and the generally cylindrically arcuate peripheral surfaces of the end portions of the pressure application structure are disposed at an angle of about 87.5 with respect to the adjacent second plane.

11. A device according to claim 8 wherein said tape contact part of the inner surface for each housing portion along a different one of the side surfaces of the roll of tape is defined by ridges extending radially from the axis of said roll of tape, and each housing portion has a recess from said tape contact part of the inner surface for each housing portion adjacent said core.

12. A device according to claim 8 wherein said means for attaching said portions of the housing together comprises a plurality of fasteners extending between said housing portions, said fasteners being adjustable to afford different maximum spacings between said tape contact parts of the inner surfaces for said housing portions.

13. A device according to claim 12 wherein said means for attaching said portions of the housing together further comprises means between said housing portions for biasing said housing portions to the maximum spacing between said tape contact parts of the inner surfaces for said housing portions provided by said fasteners.

14. A device according to claim 12 wherein said fasteners afford free relative movement of the portions of the housing between the maximum spacing between said tape contact parts of the inner surfaces for said housing portions provided by said fasteners, and a position with said tape contact parts in contact with the side surfaces of said roll of tape.

15. A device according to claim 8 wherein said means for attaching said portions of the housing together attaches the portions of the housing together in a fixed relationship with said tape contact parts of the inner surfaces for said housing portions at a predetermined spaced relationship with respect to the side surfaces of said roll of tape.

16. A device according to claim 8 wherein each of said end portions of said pressure application structure have end surfaces projecting in the range of about 0.005 to 0.020 inch or 0.01 to 0.05 centimeter beyond the intersections of said first and second planes.

17. A device according to claim 8 further including means for providing a sharp edge on said housing adjacent said pressure application structure adapted for severing tape applied to the surface to be protected from tape in said device by manual manipulation of the device.

18. A device according to claim 8 further including a handle comprising an elongate central portion adapted for manual engagement, said elongate central portion having an axis and having opposite ends, said handle including end portions attached to said opposite ends and projecting in the same direction generally normal to the axis of said central portion, said end portions having ends opposite said central portion pivotally attached to said housing to afford movement of said handle between positions along either of said outer surfaces of said housing portions.

19. A device according to claim 8 wherein each of said end portions of said pressure application structure comprises a pressure roller having a peripheral surface that is generally cylindrical about an axis, said outer edge is at one end of said peripheral surface, and said pressure roller is mounted on the housing for rotation about said axes with a part of the outer edge of the pressure roller at the intersection of the adjacent first and second planes and the generally cylindrical peripheral surface of the pressure roller is disposed at an angle of no greater than 90 degrees with respect to the adjacent second plane and projections from the housing at the intersection of the adjacent first and second planes.

* * * * *

UNITED STATES PATENT AND TRADEMARK OFFICE

CERTIFICATE OF CORRECTION

PATENT NO. : 6,742,562 B2
APPLICATION NO. : 10/179602
DATED : June 1, 2004
INVENTOR(S) : James F. Pitzen It is certified that error appears in the above-identified patent and that said Letters Patent is hereby corrected as shown below:

Sheet 1 of 6 thru Sheet 6 of 6
Delete informal drawings Figs. 1-10 and replace with attached formal drawings Figs. 1-10

Column 8
Line 38, delete "10" and insert --110--
Line 46, delete "10" and insert --110--

Column 9
Line 61, delete "10" and insert --110--

Column 10
Line 34, delete "10" and insert --110--

Column 12
Line 44, after "alignment" insert --,--

Column 14
Line 38, delete "projections" and insert --projects--

Signed and Sealed this

Twenty-fifth Day of March, 2008

JON W. DUDAS
*Director of the United States Patent and Trademark Office*

UNITED STATES PATENT AND TRADEMARK OFFICE

CERTIFICATE OF CORRECTION

PATENT NO. : 6,742,562 B2
APPLICATION NO. : 10/179602
DATED : June 1, 2004
INVENTOR(S) : James F. Pitzen It is certified that error appears in the above-identified patent and that said Letters Patent is hereby corrected as shown below:

Delete the title page and substitute therefor the attached title page.

Sheet 1 of 6 thru Sheet 6 of 6
Delete informal drawings Figs. 1-10 and replace with attached formal drawings Figs. 1-10

Column 8
Line 38, delete "10" and insert --110--
Line 46, delete "10" and insert --110--

Column 9
Line 61, delete "10" and insert --110--

Column 10
Line 34, delete "10" and insert --110--

Column 12
Line 44, after "alignment" insert --,--

Column 14
Line 38, delete "projections" and insert --projects--

This certificate supersedes the Certificate of Correction issued March 25, 2008.

Signed and Sealed this

Twenty Second Day of April, 2008

JON W. DUDAS
*Director of the United States Patent and Trademark Office*

(12) United States Patent
Pitzen

(10) Patent No.: US 6,742,562 B2
(45) Date of Patent: Jun. 1, 2004

(54) MASKING TAPE APPLICATOR

(75) Inventor: James F. Pitzen, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/179,602

(22) Filed: Jun. 25, 2002

(65) Prior Publication Data

US 2003/0234083 A1 Dec. 25, 2003

(51) Int. Cl.[7] ..... B44C 7/04
(52) U.S. Cl. ..... 156/577; 156/579; 156/527
(58) Field of Search ..... 156/577, 579, 156/523, 527

(56) References Cited

U.S. PATENT DOCUMENTS

| | | | | |
|---|---|---|---|---|
| 2,891,691 | A * | 6/1959 | Burger | 156/577 |
| 2,953,274 | A * | 9/1960 | Bertschinger | 156/577 |
| 3,156,603 | A * | 11/1964 | Robinson | 156/577 |
| 3,740,297 | A * | 6/1973 | Vidinsky | 156/523 |
| 5,269,871 | A | 12/1993 | Longworth et al. | |
| 5,462,633 | A * | 10/1995 | Manusch et al. | 156/577 |
| 6,302,177 | B1 * | 10/2001 | Gruber | 156/527 |

* cited by examiner

*Primary Examiner*—Richard Crispino
*Assistant Examiner*—Michelle Acevedo Lazor
(74) *Attorney, Agent, or Firm*—William L. Huebsch

(57) ABSTRACT

A device for applying tape from a roll of tape (e.g., masking tape) along a surface to be protected with an edge of the tape extending along a juncture between the surface to be protected and a surface to be treated disposed at about a right angle with respect to the surface to be protected. The device includes a two portion housing around and journaling the tape roll, each portion having a tape contacting part of its inner surface in a first plane, and having in a second plane a guide part of its outer surface adapted to be slid along the surface to be treated. The first and second planes on each of the housing portions can be at a small angle with respect to each other and intersect along an application side of the housing. A pressure application structure is mounted on the housing with an outer edge each end of the pressure application structure at the intersection of the first and second planes for a different adjacent one of the housing portions, and with the generally cylindrically arcuate peripheral surface of the pressure application structure disposed at an angle of no greater than 90 degrees with respect to the second plane and projecting from the housing at the intersections of the first and second planes. Tape from the roll extends around the periphery of the pressure application structure so that the dispenser can be manually positioned with either housing portion against the surface to be treated and moved to apply the tape.

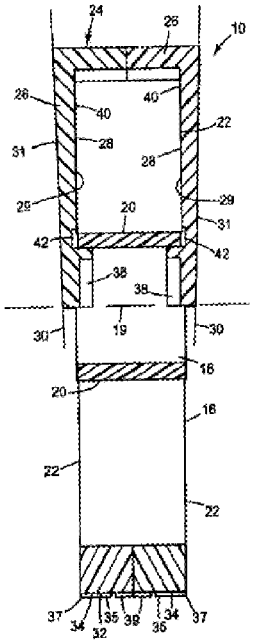

19 Claims, 6 Drawing Sheets